US006835944B2

(12) United States Patent
Orsini et al.

(10) Patent No.: US 6,835,944 B2
(45) Date of Patent: Dec. 28, 2004

(54) LOW VAPOR PRESSURE, LOW DEBRIS SOLID TARGET FOR EUV PRODUCTION

(75) Inventors: Rocco A. Orsini, Long Beach, CA (US); Michael B. Petach, Redondo Beach, CA (US); Mark E. Michaelian, Torrance, CA (US); Henry Shields, San Pedro, CA (US); Roy D. McGregor, El Camino Village, CA (US); Steven W. Fornaca, Torrance, CA (US)

(73) Assignee: University of Central Florida Research Foundation, Orlanda, FL (US)

( * ) Notice: Subject to any disclaimer, the term of this patent is extended or adjusted under 35 U.S.C. 154(b) by 164 days.

(21) Appl. No.: 10/269,760

(22) Filed: Oct. 11, 2002

(65) Prior Publication Data

US 2004/0071266 A1 Apr. 15, 2004

(51) Int. Cl.[7] ..... H01J 35/00

(52) U.S. Cl. ..... 250/504 R; 250/492.2; 378/119; 359/329

(58) Field of Search ..... 250/504 R, 492.2; 378/119; 359/329; 315/111.21

(56) References Cited

U.S. PATENT DOCUMENTS 6,002,744 A 12/1999 Hertz et al.
6,324,256 B1 * 11/2001 McGregor et al. ..... 378/119
6,657,213 B2 * 12/2003 Orsini et al. ..... 250/504 R

OTHER PUBLICATIONS

Sogard, M., "Apparatus and Method for Containing Debris from Laser Plasma Radiation Sources", Pub. No: US 2002/0090054 A1, publication date: Jul. 11, 2002.*

Rymell, L.; Berglund, M; Hansson, B.A.M.; and Hertz, H.M.; "X–Ray and EUV Laser–Plasma Sources Based on Cryogenic Liquid–Jet Target"; Biomedical and X–Ray Physics, Royal Institute of Technology, SE–10044 Stockholm, Sweden; Part of SPIE Conference on Emerging Lithograph Technologies III, Santa Clara, California, Mar. 1999; pp. 421–423.

Gouge, Michael J. and Fisher, Paul W.; "A Cryogenic Xenon Droplet Generator for Use in a Compact Laser Plasma X–Ray Source"; Feb. 11, 1997; pp. 2158–2162.

* cited by examiner

*Primary Examiner*—Nikita Wells
*Assistant Examiner*—Zia R. Hashmi
(74) *Attorney, Agent, or Firm*—John A. Miller; Warn, Hoffman, Miller & LaLone, P.C.

(57) ABSTRACT

An EUV radiation source that creates a stable solid filament target. The source includes a nozzle assembly having a condenser chamber for cryogenically cooling a gaseous target material into a liquid state. The liquid target material is filtered by a filter and sent to a holding chamber under pressure. The holding chamber allows entrained gas bubbles in the target material to be condensed into liquid prior to the filament target being emitted from the nozzle assembly. The target material is forced through a nozzle outlet tube to be emitted from the nozzle assembly as a liquid target stream. A thermal shield is provided around the outlet tube to maintain the liquid target material in the cryogenic state. The liquid target stream freezes and is vaporized by a laser beam from a laser source to generate the EUV radiation.

25 Claims, 1 Drawing Sheet

LOW VAPOR PRESSURE, LOW DEBRIS SOLID TARGET FOR EUV PRODUCTION

BACKGROUND OF THE INVENTION

1. Field of the Invention

This invention relates generally to a laser-plasma extreme ultraviolet (EUV) radiation source and, more particularly, to a laser-plasma EUV radiation source that provides a stable solid filament target.

2. Discussion of the Related Art

Microelectronic integrated circuits are typically patterned on a substrate by a photolithography process, well known to those skilled in the art, where the circuit elements are defined by a light beam propagating through a mask. As the state of the art of the photolithography process and integrated circuit architecture becomes more developed, the circuit elements become smaller and more closely spaced together. As the circuit elements become smaller, it is necessary to employ photolithography light sources that generate light beams having shorter wavelengths and higher frequencies. In other words, the resolution of the photolithography process increases as the wavelength of the light source decreases to allow smaller integrated circuit elements to be defined. The current trend for photolithography light sources is to develop a system that generates light in the extreme ultraviolet (EUV) or soft X-ray wavelengths (13–14 nm).

Various devices are known in the art to generate EUV radiation. One of the most popular EUV radiation sources is a laser-plasma, gas condensation source that uses a gas, typically Xenon, as a laser plasma target material. Other gases, such as Argon and Krypton, and combinations of gases, are also known for the laser target material. In the known EUV radiation sources based on laser produced plasmas (LPP), the gas is typically cryogenically cooled in a nozzle to a liquid state, and then forced through an orifice or other nozzle opening into a vacuum chamber as a continuous liquid stream or filament. Cryogenically cooled target materials, which are gases at room temperature, are required because they do not condense on the EUV optics, and because they produce minimal byproducts that have to be evacuated by the vacuum chamber. In some designs, the nozzle is agitated so that the target material is emitted from the nozzle as a stream of liquid droplets having a certain diameter (30–100 $\mu$m) and a predetermined droplet spacing.

The low temperature of the liquid target material and the low vapor pressure within the vacuum environment cause the target material to quickly freeze. Some designs employ sheets of frozen cryogenic material on a rotating substrate, but this is impractical for production EUV sources because of debris and repetition rate limitations.

The target stream is illuminated by a high-power laser beam, typically from an Nd:YAG laser, that heats the target material to produce a high temperature plasma which emits the EUV radiation. The laser beam is delivered to a target area as laser pulses having a desirable frequency. The laser beam must have a certain intensity at the target area in order to provide enough heat to generate the plasma.

FIG. 1 is a plan view of an EUV radiation source 10 of the type discussed above including a nozzle 12 having a target material chamber 14 that stores a suitable target material, such as Xenon, under pressure. The chamber 14 includes a heat exchanger or condenser that cryogenically cools the target material to a liquid state. The liquid target material is forced through a narrowed throat portion 16 of the nozzle 12 to be emitted as a filament or stream 18 into a vacuum chamber towards a target area 20. The liquid target material will quickly freeze in the vacuum environment to form a solid filament of the target material as it propagates towards the target area 20. The vacuum environment and vapor pressure within the target material will cause the frozen target material to eventually break up into frozen target fragments, depending on the distance that the stream 18 travels.

A laser beam 22 from a laser source 24 is directed towards the target area 20 to vaporize the target material. The heat from the laser beam 22 causes the target material to generate a plasma 30 that radiates EUV radiation 32. The EUV radiation 32 is collected by collector optics 34 and is directed to the circuit (not shown) being patterned. The collector optics 34 can have any shape suitable for the purposes of collecting and directing the radiation 32, such as a parabolic shape. In this design, the laser beam 22 propagates through an opening 36 in the collector optics 34, as shown. Other designs can employ other configurations.

In an alternate design, the throat portion 16 can be vibrated by a suitable device, such as a piezoelectric vibrator, to cause the liquid target material being emitted therefrom to form a stream of droplets. The frequency of the agitation determines the size and spacing of the droplets. If the target stream 18 is a series of droplets, the laser beam 22 is pulsed to impinge every droplet, or every certain number of droplets.

It is desirable that an EUV source has a good conversion efficiency. Conversion efficiency is a measure of the laser beam energy that is converted into recoverable EUV radiation. In order to achieve a good conversion efficiency, the target stream vapor pressure must be minimized because gaseous target material tends to absorb the generated EUV radiation. Further, liquid cryogen delivery systems operating near the gas-liquid phase saturation line of the target fluid's phase diagram are typically unable to project a stream of target material significant distances before instabilities in the stream cause it to break up or cause droplets to be formed. As a result, the time the stream is in the vacuum chamber prior to stream break-up will be insufficient to allow evaporative cooling to freeze the stream and thereby lower its vapor pressure. Moreover, the distance between the nozzle and the target area must be maximized to keep source heating and condensable source debris to a minimum.

SUMMARY OF THE INVENTION

In accordance with the teachings of the present invention, an EUV radiation source is disclosed that creates a stable solid filament target. The source includes a nozzle assembly having a condenser chamber for cryogenically cooling a gaseous target material into a liquid state. The liquid target material is filtered and sent to a holding chamber under pressure. The holding chamber allows entrained gas bubbles in the target material to condense into liquid prior to the filament target being emitted from the nozzle assembly. The target material is forced through a nozzle outlet tube to be emitted from the nozzle assembly into a vacuum chamber as a liquid target stream. A thermal shield is provided around the outlet tube to maintain the liquid target material in the cryogenic state. The liquid target stream freezes in the vacuum chamber and is vaporized by a laser beam from a laser source to generate the EUV radiation.

Additional objects, advantages and features of the present invention will become apparent from the following description and appended claims, taken in conjunction with the accompanying drawings.

DETAILED DESCRIPTION OF THE EMBODIMENTS

Figure 1:
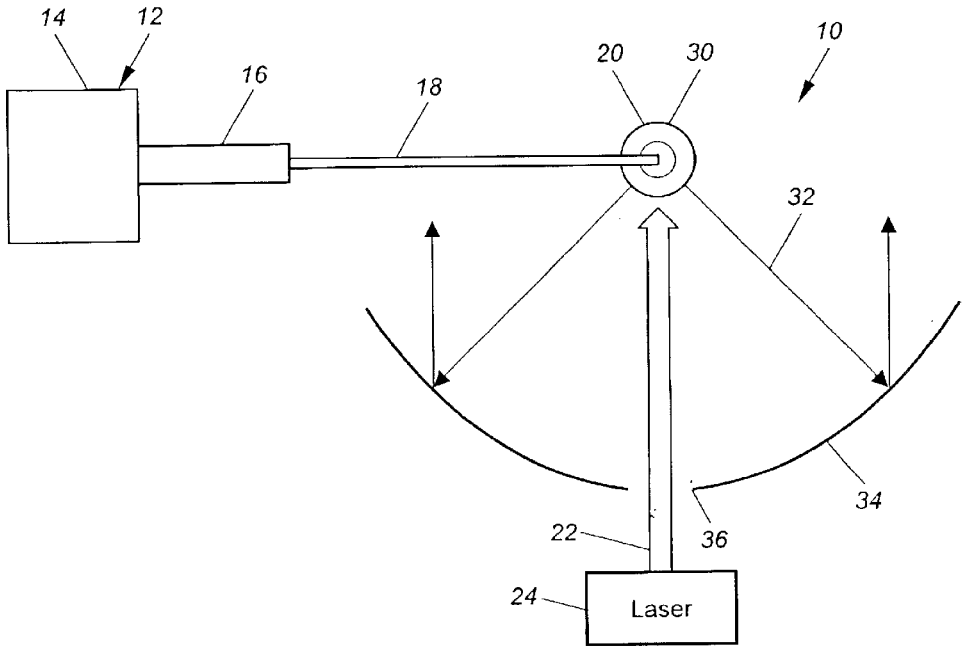
FIG. 1 is a plan view of a laser-plasma EUV radiation source.

The following discussion of the embodiments of the invention directed to an EUV radiation source that provides a stable solid filament target is merely exemplary in nature, and is in no way intended to limit the invention or its applications or uses.

The present invention is a nozzle for an EUV radiation source that creates a stable solid filament target for efficient production of EUV radiation. Carefully designed cryogenic fluid handling and temperature controls are employed in the invention to create a fluid stream sufficiently stable to establish a solid frozen filament of the target material at distances on the order of 4 cm or more from the nozzle outlet. Typical filament diameters are about 30–100 $\mu$m based primarily on EUV system vacuum requirements rather than physical constraints on filament production. Desired minimum operating pressures for Xenon range from 45 to 300 psia which provides a target stream velocity of about 20 meters/second. This stream velocity will support pulsed laser operation at 6 kHz. Higher pressures increase stream velocity and tend to promote stream stability.

To obtain the stable solid target filaments, care must be taken to ensure that a high quality liquid target material is supplied to the nozzle. In this context, quality refers to the cooling capacity per unit weight of the target gas. Poor target quality results in excessive boil-off of the target fluid upon exiting the nozzle, thereby creating stream instabilities and break-up before freezing is achieved. This is characteristic of target droplet generation where boil-off and Rayleigh instabilities contribute to stream break-up while the stream is still in a predominantly liquid state. Three elements are required to obtain high target liquid quality, and include super cooling of the target gas below its boiling point, separation of the gas and liquid phases present in the condenser, and maintaining high liquid quality up to the nozzle outlet. Stable solid Xenon streams require supercooling to a temperature of 170 K, which corresponds to at least 18 degrees of supercooling for typical operating pressures.

Gas and liquid target material are both present and are, at some point, in equilibrium within the condenser. Separation of gas and liquid phases in the condenser effluent is critical because entrained gas in the liquid target material contributes to stream instability without contributing to evaporative cooling that is necessary to form a solid frozen target. Of particular concern are entrained gas bubbles of small diameter. Effective phase separation may be achieved by a combination of filtration from the condenser packing material, such as a fine screen or sintered metal granules, and/or residence time upstream of the nozzle outlet.

Maintaining a high liquid quality from the condenser to the nozzle outlet requires that the nozzle outlet tube be thermally shielded from the surrounding ambient temperature hardware. Moreover, all target delivery tubing and nozzle dimensions must be minimized to reduce the thermal load intercepted from the plasma. With a 5 kW laser and a nozzle tube diameter of 0.5 mm, the front face of the tube can absorb about 230 mW of plasma energy. With a Xenon flow rate of 1 standard liter per minute, this corresponds to a liquid temperature rise of about 7K. Flow rates in the range of 1 to 4 standard liters per minute may be used.

The production of a stable target filament requires careful consideration of the details of the fluid flow both in the outlet tube and particularly in the outlet orifice through which the target filament is injected into the vacuum chamber. A stable filament requires that the liquid stream exiting the nozzle should be very steady and have minimum possible spatial variations in velocity and temperature. The presence of vapor bubbles from either cavitation or boiling at the nozzle wall must also be minimized. The outlet tube and nozzle materials must be carefully selected to provide the necessary shape and smoothness of the flow path while also having mechanical and thermal properties appropriate to successful operation in a plasma environment. A variety of nozzle/orifice shapes can be employed to produce reasonable stable filaments. However, since sharp edged orifices are more prone to inducing cavitation, a smoothly converging nozzle, such as that obtained from drawn capillary tubing, is a preferred approach.

Figure 2:
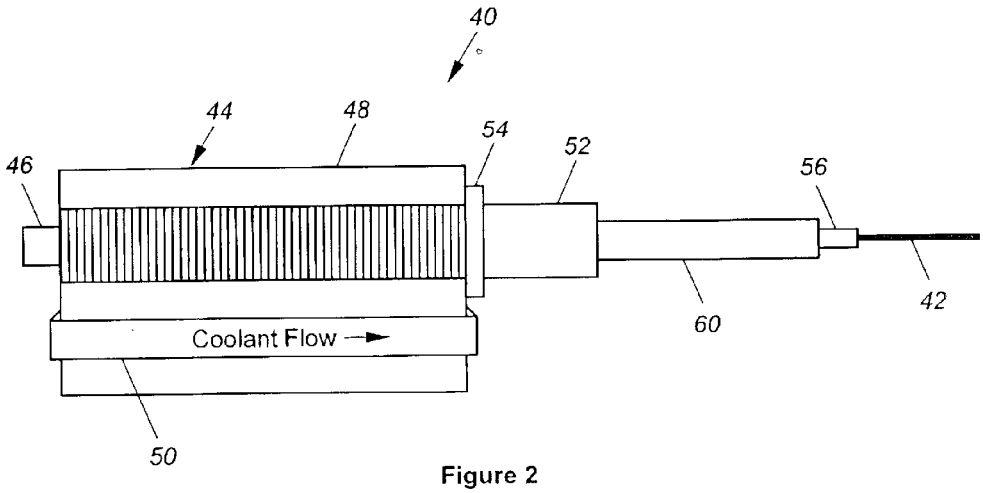
FIG. 2 is a plan view of a nozzle assembly providing a stable solid filament target for the radiation source shown in FIG. 1, according to an embodiment of the present invention.

FIG. 2 is a partial cross-sectional view of a nozzle assembly 40 that can replace the nozzle 12 in the source 10, where the nozzle assembly 40 includes the various design concerns discussed above to produce a stable solid filament target stream 42. The nozzle assembly 40 includes a condenser chamber 44 for cooling a target material, such as Xenon, to a liquid state. The target gas is introduced into the chamber 44 through an inlet port 46. A condenser 48 provided in the chamber 42 receives the target material and acts as a heat exchanger to cryogenically cool the target material. A coolant flow loop 50 is provided in the chamber 44 to circulate a refrigerant to chill the target gas propagating through the condenser 48. In one embodiment, the refrigerant is boil-off from liquid nitrogen that is at a carefully controlled temperature to convert the target gas to a liquid state. The chamber 44 is made of a thermally conducting material so that the refrigerant temperature is efficiently transferred to the condenser 48.

The liquid target material is sent from the condenser chamber 44 to a holding chamber 52 through a liquid filter 54. The filter 54 can be any suitable filter for the purposes described herein, such as a screen, that removes particulate matter from the liquid target material. The filter 54 removes the particulates in the liquid target material to prevent the various small openings in the nozzle assembly 40 from being clogged. Additionally, the filter 54 also helps in removing gas bubbles trapped therein. The condenser 48 can also provide target material filtering, such as including sintered metal granules or the like.

As discussed above, the vapor pressure caused by entrained gas in the target stream 42 acts to break up the target stream 42 reducing its ability to be effectively heated by the laser beam 22 to generate the EUV radiation 32. The phase conversion of the target gas to liquid in the nozzle assembly 40 must be performed over a suitable period of time at the proper temperature in order to remove most of the entrained gas bubbles in the liquid. The condenser 48 can be made a suitable length to perform this purpose, or the partially converted target material can be held in the chamber 52 at the reduced temperature until most of the gas bubbles are converted to liquid. Thus, the holding chamber 52 acts to increase the stability of the target stream 42. The holding chamber 52 allows the entrained gas bubbles to rise in the fluid, and be prevented from being emitted from the nozzle assembly 40. The fluid flow rate through the holding chamber 52 determines its fluid holding capacity for a particular application.

From the holding chamber 52, the liquid target material is forced through an outlet tube 56 under pressure to generate the stream 42 of the liquid target material that is emitted from the nozzle assembly 40. The outlet tube 56 can have an inner diameter, such as 50 $\mu$m, to generate the diameter target stream that is desired. The outlet tube 56 can be a capillary tube that is made of any material, such as metal or glass, suitable for the purposes discussed herein. The length of the tube 56 is application specific, and will depend on the requirements of a particular EUV source.

A thermal shield 60 is provided around the tube 56 to maintain the temperature of the target material propagating therethrough to maintain the stability of the target stream 42. The thermal shield 60 can be any suitable thermal shield for the purposes described herein, such as a tube of copper or aluminum. Additionally, the thermal shield 60 can be made up of several layers of materials having a vacuum between the layers to increase thermal protection. The liquid stream 42 quickly freezes into a frozen stream in the vacuum chamber of the source 10.

The foregoing discussion discloses and describes merely exemplary embodiments of the present invention. One skilled in the art will readily recognize from such discussion and from the accompanying drawings and claims, that various changes, modifications and variations can be made therein without departing from the spirit and scope of the invention as defined in the following claims.

What is claimed is:

1. An extreme ultraviolet (EUV) radiation source for generating EUV radiation, said source comprising:

a nozzle assembly, said nozzle assembly including a condenser chamber having a condenser for cryogenically cooling a gas target material to a liquid target material, said nozzle assembly further including a holding chamber receiving the liquid target material and holding the target material under pressure to allow entrained gas bubbles in the liquid target material to be converted to liquid, said nozzle assembly further including an outlet opening coupled to the holding chamber, said outlet opening receiving the liquid target material from the holding chamber and emitting a stable stream of the target material from the nozzle assembly towards a target area; and a laser, said laser directing a laser beam to the target area to vaporize the target material and create a plasma that emits the EUV radiation.

2. The source according to claim 1 wherein the outlet opening is at an outlet end of a capillary tube, said capillary tube being in fluid communication with the holding chamber.

3. The source according to claim 2 wherein the capillary tube is a drawn capillary tube so that the outlet opening is smooth.

4. The source according to claim 2 wherein the nozzle assembly further includes a thermal shield formed around the capillary tube.

5. The source according to claim 4 wherein the thermal shield includes a plurality of shield layers defining a space therebetween.

6. The source according to claim 1 wherein the nozzle assembly further includes a filter for filtering the liquid target material.

7. The source according to claim 6 wherein the filter is positioned between the condenser chamber and the holding chamber.

8. The source according to claim 1 wherein the outlet opening is a circular opening providing a target stream having a diameter in the range of 30–100 $\mu$m.

9. The source according to claim 1 wherein the target material is Xenon.

10. The source according to claim 9 wherein the Xenon has a flow rate of 1 standard liter per minute through the nozzle assembly.

11. An extreme ultraviolet (EUV) radiation source for generating EUV radiation, said source comprising:

a nozzle assembly, said nozzle assembly including a condenser chamber having a condenser for cryogenically cooling a gas target material to a liquid target material, said nozzle assembly further including a filter for filtering the liquid target material, said nozzle assembly further including a holding chamber receiving the liquid target material and holding the target material under pressure to allow entrained gas bubbles in the liquid target material to be converted to liquid, said nozzle assembly further including a capillary outlet tube coupled to the holding chamber, said outlet tube receiving the liquid target material from the holding chamber and emitting a stable stream of the target material from the nozzle assembly towards a target area; and a laser, said laser directing a laser beam to the target area to vaporize the target material and create a plasma that emits the EUV radiation.

12. The source according to claim 11 wherein the nozzle assembly further includes a thermal shield formed around the capillary tube.

13. The source according to claim 12 wherein the thermal shield includes a plurality of shield layers defining a space therebetween.

14. The source according to claim 11 wherein the filter is positioned between the condenser chamber and the holding chamber.

15. A nozzle assembly for an extreme ultraviolet (EUV) radiation source, said nozzle assembly comprising:

a condenser chamber including a condenser for cryogenically cooling a gas target material to a liquid target material;

a holding chamber receiving the liquid target material from the condenser chamber and holding the liquid target material under pressure to allow entrained gas bubbles in the liquid target material to be converted to liquid; and an outlet opening coupled to the holding chamber, said outlet opening emitting a stable stream of the target material from the nozzle assembly.

16. The nozzle assembly according to claim 15 wherein the outlet opening is at an outlet end of a capillary tube, said capillary tube being in fluid communication with the holding chamber.

17. The nozzle assembly according to claim 16 wherein the capillary tube is a drawn capillary tube so that the outlet opening is smooth.

18. The nozzle assembly according to claim 16 further comprising a thermal shield formed around the capillary tube.

19. The nozzle assembly according to claim 18 wherein the thermal shield includes a plurality of shield layers defining a space therebetween.

20. The nozzle assembly according to claim 15 further comprising a filter for filtering the liquid target material.

21. The nozzle assembly according to claim 20 wherein the filter is positioned between the condenser chamber and the holding chamber.

22. A method of generating a stable stream of a target material emitted from a nozzle of an extreme ultraviolet (EUV) radiation source, comprising:

cryogenically cooling a gas target material to a liquid target material;

holding the liquid target material in a holding chamber for a predetermined time period to allow entrained gas bubbles in the target material to be converted to liquid;

emitting the liquid target material from an outlet opening of the nozzle as the stable stream of the target material; and directing a laser beam to the target material to vaporize the target material and create a plasma that emits the EUV radiation.

23. The method according to claim 22 wherein emitting the target stream through an outlet opening includes emitting the target stream through a capillary outlet tube.

24. The method according to claim 23 further comprising providing a thermal shield around the capillary tube to maintain the target material in a cryogenic state therein.

25. The method according to claim 22 further comprising filtering the liquid target material in the nozzle.

* * * * *